US010583951B2

(12) United States Patent
Farahani

(10) Patent No.: US 10,583,951 B2
(45) Date of Patent: Mar. 10, 2020

(54) EASY WASH SPLIT BOTTLE ASSEMBLY

(71) Applicant: Sharon J. Farahani, Woodbridge, CT (US)

(72) Inventor: Sharon J. Farahani, Woodbridge, CT (US)

( * ) Notice: Subject to any disclaimer, the term of this patent is extended or adjusted under 35 U.S.C. 154(b) by 138 days.

(21) Appl. No.: 15/817,939

(22) Filed: Nov. 20, 2017

(65) Prior Publication Data

US 2019/0152642 A1 May 23, 2019

(51) Int. Cl.

| | |
|---|---|
| ***B65D 1/04*** | (2006.01) |
| ***B65D 1/02*** | (2006.01) |
| ***B65D 41/04*** | (2006.01) |
| ***B65D 8/00*** | (2006.01) |

(52) U.S. Cl.

CPC ..... *B65D 1/04* (2013.01); *B65D 1/0207* (2013.01); *B65D 1/0246* (2013.01); *B65D 1/0276* (2013.01); *B65D 11/04* (2013.01); *B65D 41/0442* (2013.01)

(58) Field of Classification Search

CPC .. B65D 1/04; B65D 21/0201; B65D 21/0204; B65D 21/0205; B65D 21/0228; B65D 81/3288; B65D 81/3283

USPC ..... 220/23.4; 215/345

See application file for complete search history.

(56) References Cited

U.S. PATENT DOCUMENTS

| | | | | |
|---|---|---|---|---|
| 2,764,309 | A * | 9/1956 | Zelonka | A45C 5/005 215/6 |
| 3,608,858 | A * | 9/1971 | Beattie | B29C 33/00 249/160 |
| 3,976,112 | A * | 8/1976 | Rowlson | B27B 33/20 144/223 |
| 4,533,057 | A | 8/1985 | Klittich | |
| 5,356,040 | A * | 10/1994 | Reggiani | B05B 11/3084 215/6 |
| 6,179,146 | B1 * | 1/2001 | Betras | B65D 21/0204 215/229 |
| 7,048,132 | B2 | 5/2006 | Yamanaka et al. | |
| 7,975,868 | B1 | 7/2011 | Flies et al. | |
| 8,459,450 | B1 | 6/2013 | Whitaker et al. | |
| 8,955,707 | B2 | 2/2015 | Lim | |

(Continued)

FOREIGN PATENT DOCUMENTS

| | | |
|---|---|---|
| CN | 201376706 Y | 1/2010 |
| CN | 204750770 U | 11/2015 |

(Continued)

OTHER PUBLICATIONS

ALEX Water Bottle, Dowloaded Sep. 21, 2017 http://www.coolthings.com/alex-bottle/ 11 pages.

(Continued)

*Primary Examiner* — Shawn M Braden
(74) *Attorney, Agent, or Firm* — Whitmyer IP Group LLC

(57) ABSTRACT

A split bottle assembly including a body, a seal, a lower collar, and an upper collar. The body is longitudinally split between a first body portion and a second body portion. The seal is between the first and second body portions. The lower collar and the upper collar are removably fastened to a lower end and an upper end of the body, respectively, thereby biasing the first and second body portions towards one another so that the seal forms a continuous fluid-tight seam therebetween.

17 Claims, 8 Drawing Sheets

(56) References Cited

U.S. PATENT DOCUMENTS

| | | | | |
|---|---|---|---|---|
| 8,991,659 | B2 * | 3/2015 | Dey | B65D 21/0201 222/132 |
| 9,402,374 | B2 | 8/2016 | Landon | |
| 9,580,227 | B2 | 2/2017 | Wood | |
| 2006/0108363 | A1 * | 5/2006 | Yates, III | B65D 1/04 220/23.4 |
| 2013/0119056 | A1 | 5/2013 | Jacobson | |
| 2017/0165689 | A1 | 6/2017 | McDonnell | |

FOREIGN PATENT DOCUMENTS

| | | | |
|---|---|---|---|
| DE | 102009006161 | A1 | 8/2010 |
| WO | 2014111489 | A2 | 7/2014 |
| WO | 2017044992 | A1 | 3/2017 |

OTHER PUBLICATIONS

HydraDuo—Why Carry One Drink When You Can Have Two, Downloaded Sep. 21, 2017 http://www.coolthings.com/hydraduo-water-bottle/ 11 pages.

Portable Silicone Water Bottle—For Travel Dogs—Petsagram, Downloaded: Sep. 21, 2017, https://petsagram.us/products/silicone-dog-water-bottle\ 6 pages.

* cited by examiner

EASY WASH SPLIT BOTTLE ASSEMBLY

TECHNICAL FIELD

The present disclosure generally relates to a drinking bottle, and more particularly relates to a drinking bottle that is split into multiple components to permit easy washing of the drinking bottle.

BACKGROUND

Reusable drinking bottles are being used with increasing frequency, due in part to the public's increased awareness about the negative environmental impact of disposable drinking bottles.

Reusable drinking bottles are commonly made from a hard plastic material, and are often sized to hold several servings of a drinkable liquid (e.g., water). Examples include the bottles sold under the Nalgene® brand by Thermo Fisher Scientific Inc. of Waltham, Mass. Such bottles typically hold approximately 32 ounces of drinkable liquid, and have a mouth that is narrow relative to the body of the bottle.

Reusable drinking bottles are designed so that they can be washed and reused multiple times. However, the shape and size of such bottles makes it difficult to thoroughly wash them (especially their inside surfaces) by hand or by dishwasher. This can be problematic from a hygiene perspective. The inability to thoroughly clean reusable drinking bottles can result in the growth of bacteria in or on the bottles. This is especially problematic considering such bottles are often left unused with water sealed therein for a long durations of time, such as when users forget the bottles in their car or gym bag. Also, such bottles are often made of a translucent hard plastic that permits light (e.g., sunlight) to pass therethrough, which can create a warm environment ideal for bacteria growth.

Attempts have been made to make a reusable drinking bottle that are disassembled into multiple parts that are easier to wash. However, such bottles can be difficult to disassemble and reassemble. Also, such bottles are prone to developing leaks at seams where the multiple parts thereof come together when the bottles are assembled.

Aspects of the present invention are directed to these and other problems.

SUMMARY

According to an aspect of the present invention, a split bottle assembly including a body, a seal, a lower collar, and an upper collar. The body is longitudinally split between a first body portion and a second body portion. The seal is between the first and second body portions. The lower collar and the upper collar are removably fastened to a lower end and an upper end of the body, respectively, thereby biasing the first and second body portions towards one another so that the seal forms a continuous fluid-tight seam therebetween.

According to another aspect of the present invention, a split bottle assembly includes a body, a sealing frame, a lower collar, and an upper collar. The body is longitudinally split between a first body portion and a second body portion. The sealing frame is positionable between the first and second body portions. The lower collar is removably fastenable to a lower end of the body. The upper collar is removably fastenable to an upper end of the body. In an assembled state of the split bottle assembly, the lower and upper collars are fastened to the lower and upper ends of the body, respectively, and thereby bias the first and second body portions towards one another so that the sealing frame forms a continuous fluid-tight seam therebetween.

In addition to, or as an alternative to, one or more of the features described above, further aspects of the present invention can include one or more of the following features, individually or in combination:

- the split bottle assembly further includes a cap removably fastened to the upper collar;
- the split bottle assembly defines a fluid tight reservoir appropriate for storing a drinkable liquid when (i) the split bottle assembly is in the assembled state, and (ii) the cap is fastened to the upper collar;
- the body is made of a hard plastic material;
- the body is made of a glass material;
- the first and second body portions each include a sidewall portion, a neck portion, and a base portion, which collectively form a sidewall, a neck, and a base of the body, respectively;
- the body has a longitudinal axis extending in a direction between the base and the neck thereof, and, when viewed in respective cross-sectional planes perpendicular to the longitudinal axis, the sidewall and the neck of the body are each annularly shaped and concentrically aligned about the longitudinal axis of the body;
- the seal includes a lower seal portion configured to form the continuous fluid-tight seam between the first and second body portions, and further includes an upper seal portion positioned between the upper collar and the upper end of the body when the upper collar is fastened thereto;
- the lower seal portion defines a generally annular shape when viewed in a cross-sectional plane perpendicular to a longitudinal axis of the body, and the upper seal portion defines a generally annular shape when viewed in a cross-sectional plane parallel to the longitudinal axis of the body;
- the seal is a discrete component relative to the body, and the lower and upper seal portions are integrally connected to one another and are made primarily of a hard plastic material;
- the lower seal includes a gasket portion made of a rubber material that is relatively soft relative to a remainder of the lower seal portion, and/or the upper seal includes a gasket portion made of a rubber material that is relatively soft relative to a remainder of the upper seal portion;
- the seal is integrally connected with one or both of the first and second body portions;
- the seal is molded onto the first and second body portions;
- the seal includes a lower seal portion configured to form the continuous fluid-tight seam between the first and second body portions, and further includes an upper seal portion positioned between the upper collar and the upper end of the body when the upper collar is fastened thereto, the lower seal portion includes a first part molded continuously along the lateral edge of the first body portion, and a substantially identical second part molded continuously along the lateral edge of the second body portion, and wherein the upper seal portion includes a first part molded continuously along the upper edge of the first body portion, and a substantially identical second part molded continuously along the upper edge of the second body portion;
- the lower collar is fastened to the lower end of the body via a threaded connection; and the upper collar is fastened to the upper end of the body via a snap-fit connection.

These and other aspects of the present invention will become apparent in light of the drawings and detailed description provided below.

DETAILED DESCRIPTION

Figure 1:
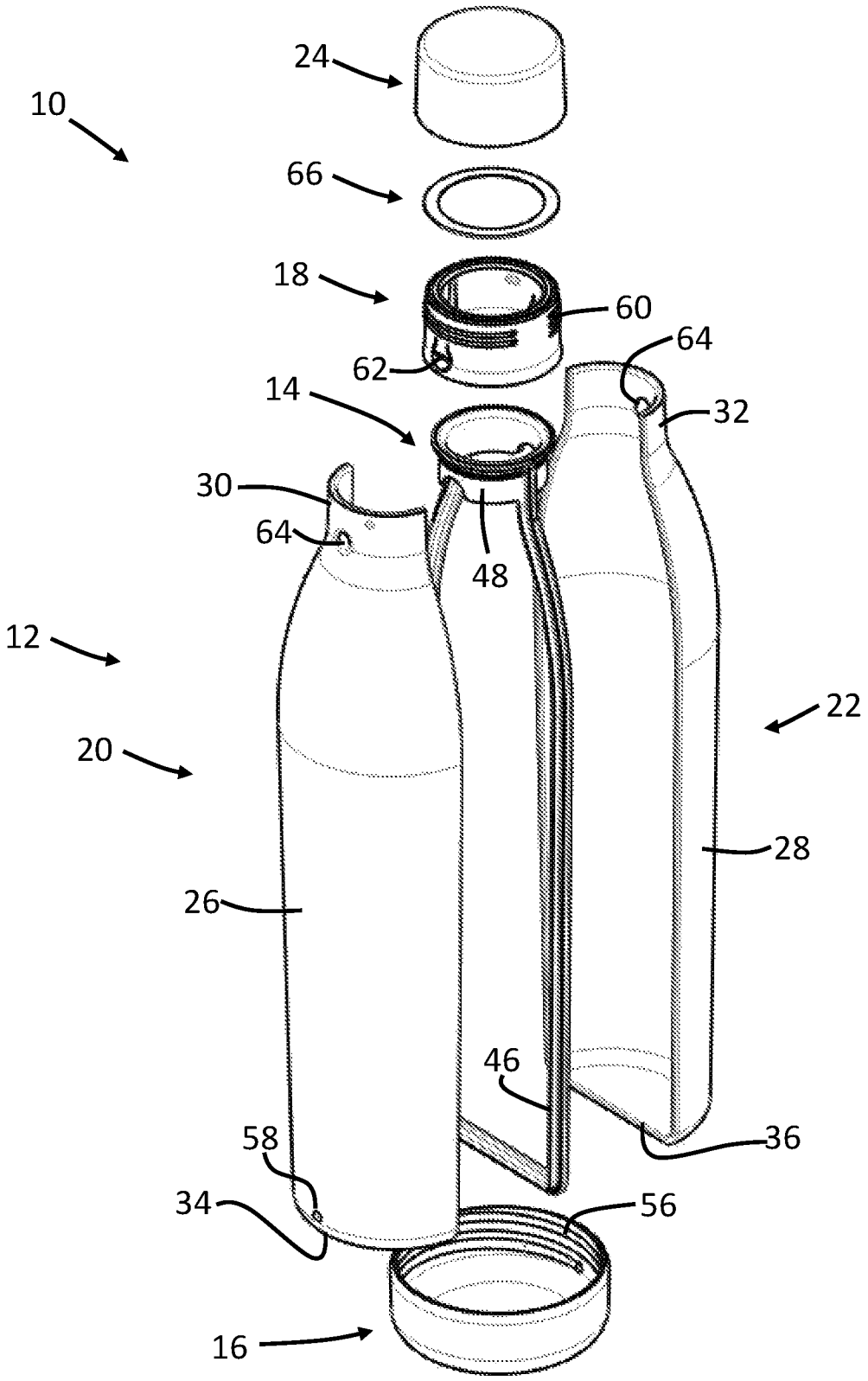
FIG. 1 is an exploded perspective view of a split bottle assembly.

Referring to FIG. 1, a split bottle assembly 10 includes at least a body 12, a seal 14, a lower collar 16, and an upper collar 18. The body 12 is split (e.g., longitudinally split) between at least a first body portion 20 and a second body portion 22 (e.g., left and right portions). The seal 14 is between the first and second body portions 20, 22. The lower collar 16 and the upper collar 18 are removably fastened to a lower end and an upper end of the body 12, respectively, and thereby bias the first and second body portions 20, 22 towards one another so that the seal 14 forms a continuous fluid-tight seam therebetween. In the illustrated embodiment, the split bottle assembly 10 additionally includes a cap 24 that is removably fastened to at least the upper collar 18. When the split bottle assembly 10 is in the assembled state and the cap 24 is fastened to the upper collar 18, the split bottle assembly 10 defines a fluid tight reservoir appropriate for storing a drinkable liquid.

Figure 2:
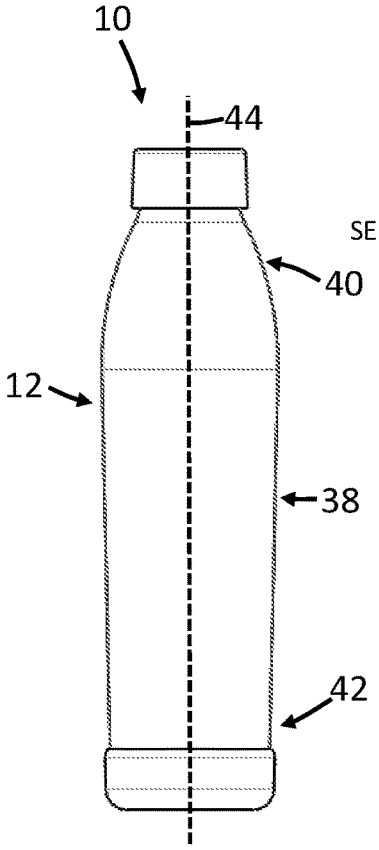
FIG. 2 is a front elevation view of the split bottle assembly of FIG. 1.
Figure 3:
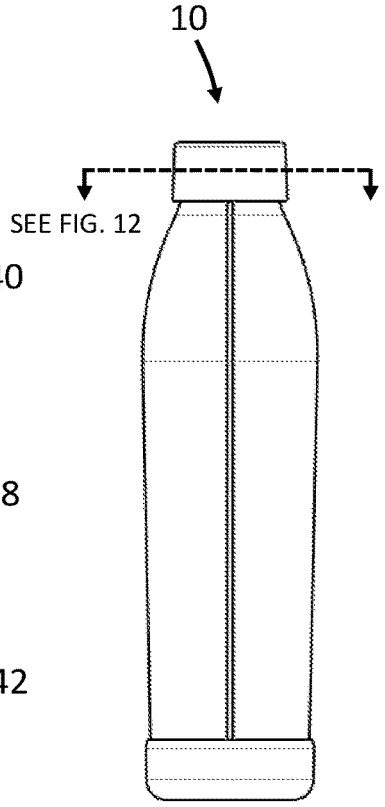
FIG. 3 is a side elevation view of the split bottle assembly.
Figure 4:
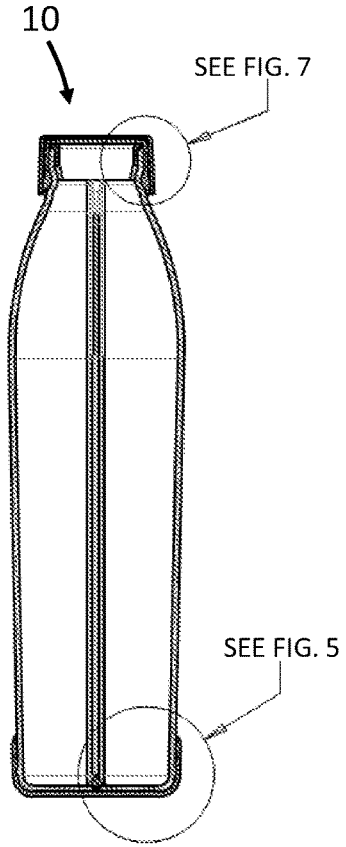
FIG. 4 is a sectional elevation view of the split bottle assembly.
Figure 5:
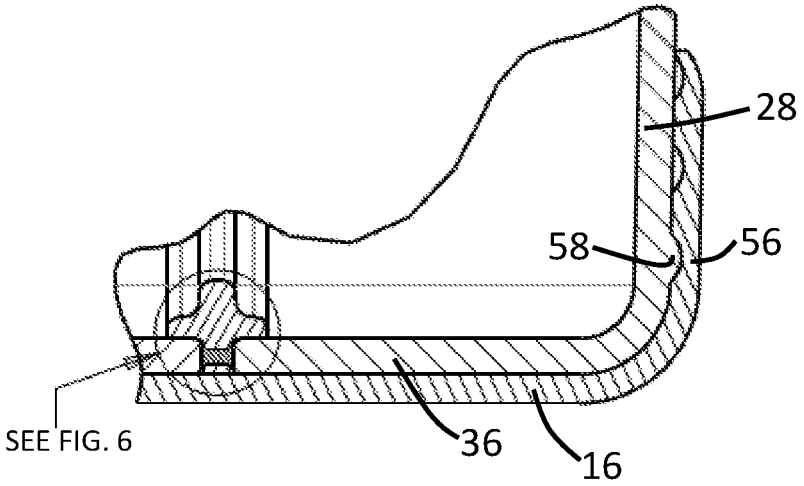
FIG. 5 is a magnified view of a portion of FIG. 4.

Referring still to FIG. 1, in the illustrated embodiment, the body 12 of the split bottle assembly 10 is longitudinally split between first and second body portions 20, 22 that are substantially identical to one another. The first and second body portions 20, 22 each include a sidewall portion 26, 28, a neck portion 30, 32, and a base portion 34, 36, which collectively form the sidewall 38, neck 40, and base 42 of the body 12 (see FIG. 2), respectively. Referring to FIG. 2, the body 12 has a longitudinal axis 44 extending in a direction between the base 42 and the neck 40 thereof. When viewed in respective cross-sectional planes perpendicular to the longitudinal axis 44, the sidewall 38 and neck 40 of the body 12 are each annularly shaped and concentrically aligned about the longitudinal axis 44 of the body 12, and the neck 40 defines a diameter that is smaller than a diameter defined by the sidewall 38. The relative degree to which the diameter of the neck 40 is smaller than the diameter of the sidewall 38 can vary and is not limited to that shown in the illustrated embodiment. In some embodiments, the body 12 is made of a hard plastic material. In other embodiments, the body 12 is made of a glass material.

Referring again to FIG. 1, in the illustrated embodiment, the seal 14 includes at least a lower seal portion 46 configured to form a continuous fluid-tight seam between the first and second body portions 20, 22 as described above. In the illustrated embodiment, the seal 14 further includes an upper seal portion 48 positioned between the upper collar 18 and the upper end of the body 12 when the upper collar 18 is fastened thereto. The lower seal portion 46 defines a generally annular shape when viewed in a cross-sectional plane parallel to the longitudinal axis 44 of the body 12, and the upper seal portion 48 defines a generally annular shape when viewed in a cross-sectional plane perpendicular to the longitudinal axis 44 of the body 12.

Figure 6:
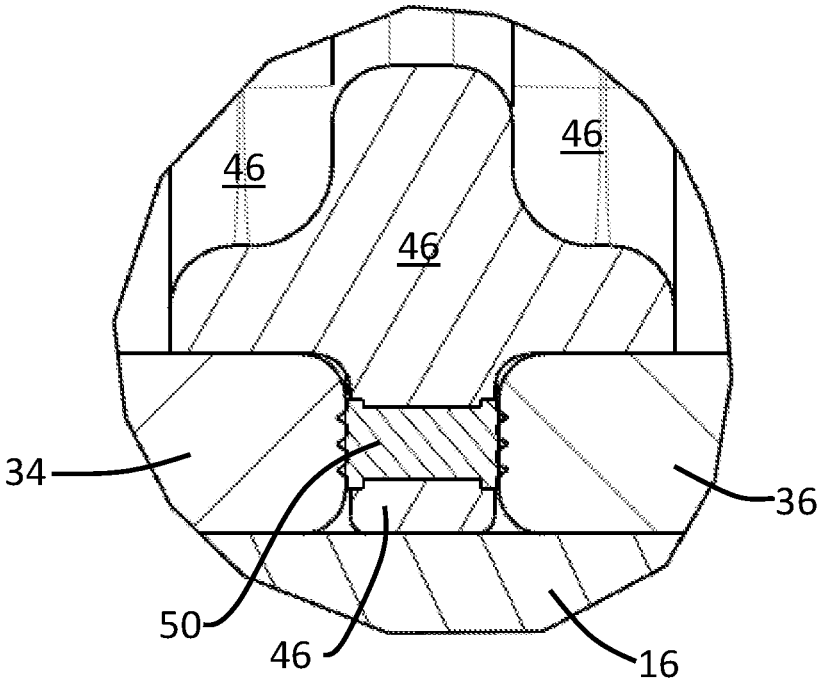
FIG. 6 is another magnified view of a portion of FIG. 4.
Figure 7:
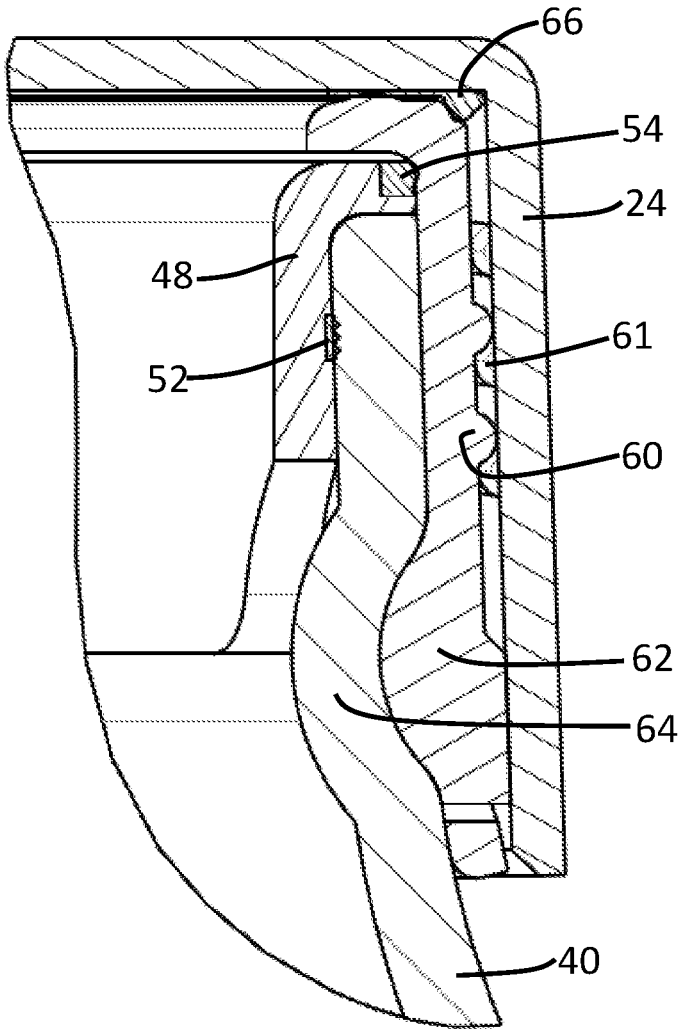
FIG. 7 is another magnified view of a portion of FIG. 4.

Referring still to FIG. 1, in the illustrated embodiment, the seal 14 is a discrete component relative to the body 12, and the lower and upper seal portions 46, 48 are integrally connected to one another and are made primarily of a hard plastic material. Referring to FIG. 6, the lower seal portion 46 also includes a gasket portion 50 made of a rubber material that is relatively soft relative to the remainder of the lower seal portion 46, which is made of a hard plastic material. The gasket portion 50 of the lower seal portion 46 extends between respective lateral edges of the first and second body portions 20, 22 when the split bottle assembly 10 is in the assembled state, and aids in maintaining the fluid-tight seam therebetween. Referring to FIG. 7, the upper seal portion 48 also includes first and second gasket portions 52, 54 made of a rubber material that is relatively soft relative to the remainder of the upper seal portion 48, which is made of a hard plastic material. The first gasket portion 52 of the upper seal portion 48 extends along an outer circumferential surface of the upper seal portion 48, and engages an inner surface of the body 12 when the split bottle assembly 10 is in the assembled stated. The first gasket portion 52 thus aids in maintaining a fluid-tight seam between the upper seal portion 48 and the body 12. The second gasket portion 54 of the upper seal portion 48 extends along a top corner of the upper seal portion 48 and engages an inner surface of the upper collar 18 when the split bottle assembly 10 is in the assembled stated. The second gasket portion 54 thus aids in maintaining a fluid-tight seam between the upper collar 18 and the body 12.

Figure 13:
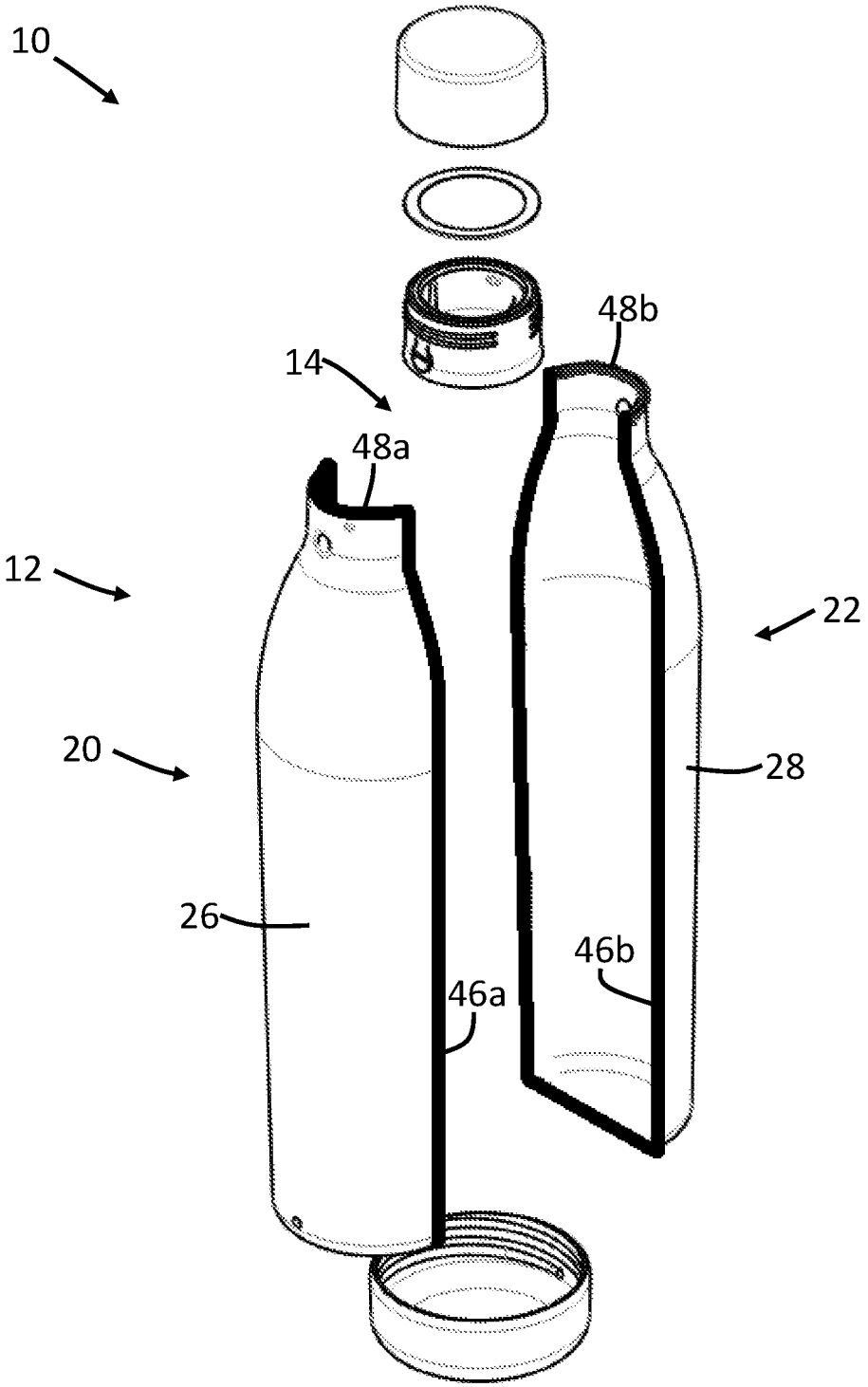
FIG. 13 is a partially schematic perspective view of a split bottle assembly in which the seal is integrally connected with the first and second body portions of the body.

In some embodiments, the seal 14 is integrally connected with one or both of the first and second body portions 20, 22. In the embodiment illustrated in FIG. 13, for example, the seal 14 is molded onto the first and second body portions 20, 22. The lower seal portion 46 includes a first part **46*a* molded continuously along the lateral edge of the first body portion 20, and a substantially identical second part 46*b* molded continuously along the lateral edge of the second body portion 22. The upper seal portion 48 includes a first part 48*a* molded continuously along the upper edge of the first body portion 20, and a substantially identical second part 48*b* molded continuously along the upper edge of the second body portion 22. In the embodiment illustrated in FIG. 13, the body 12 is made of a glass material, and the seal 14 is made of a relatively soft rubber material, such as that used in the gasket portions 50, 52, 54 in the embodiment of FIG. 1-12**.

Referring again to FIG. 1, the lower collar 16 includes an annular sidewall 38 and a base 42. The lower end of the body 12 includes an inner surface with an annularly-extending thread 56 configured to threadably engage at least one pin 58 extending outward from an outer surface of the base 42 of the body 12, which thereby permits removable fastening of the lower collar 16 to a lower end of the body 12.

Figure 8:
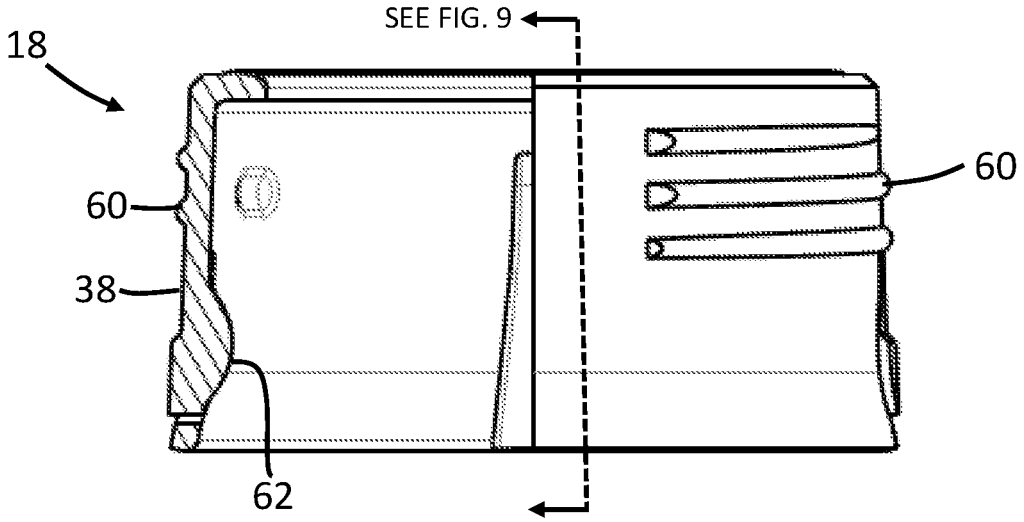
FIG. 8 is an elevation view of the upper collar of the split bottle assembly.
Figure 9:
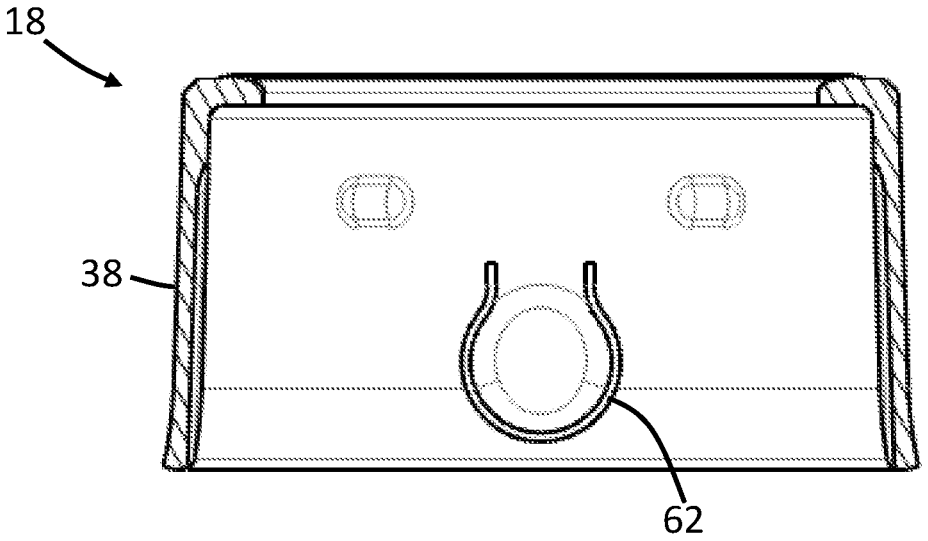
FIG. 9 is another elevation view of the upper collar.
Figure 10:
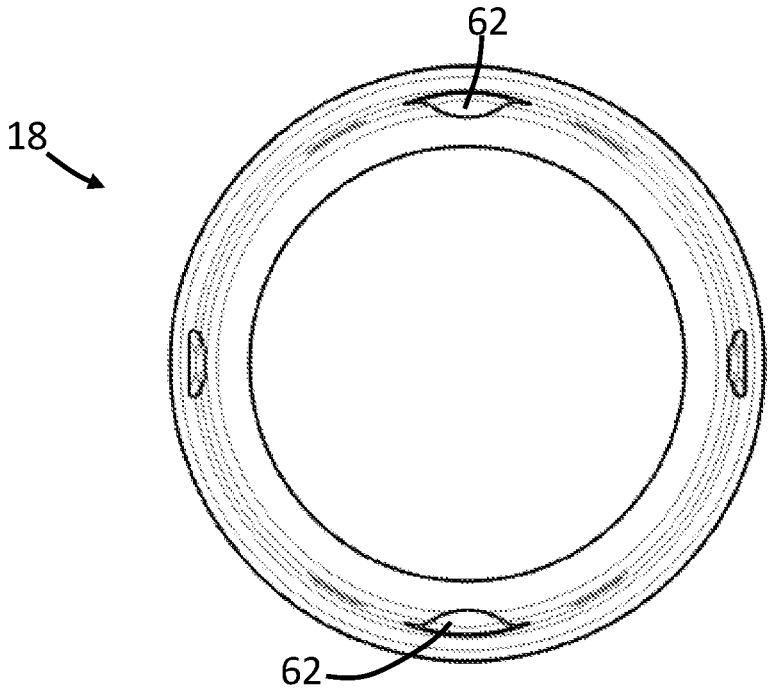
FIG. 10 is a bottom plan view of the upper collar.
Figure 11:
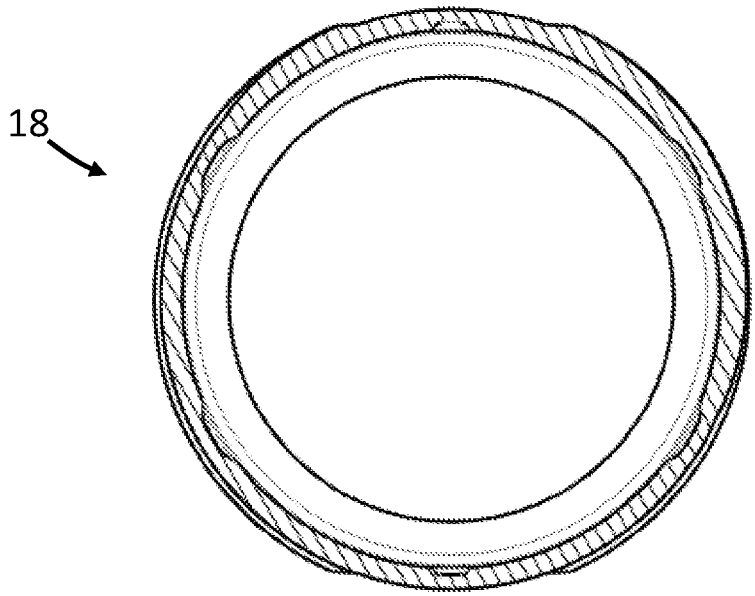
FIG. 11 is a top plan view of the upper collar.
Figure 12:
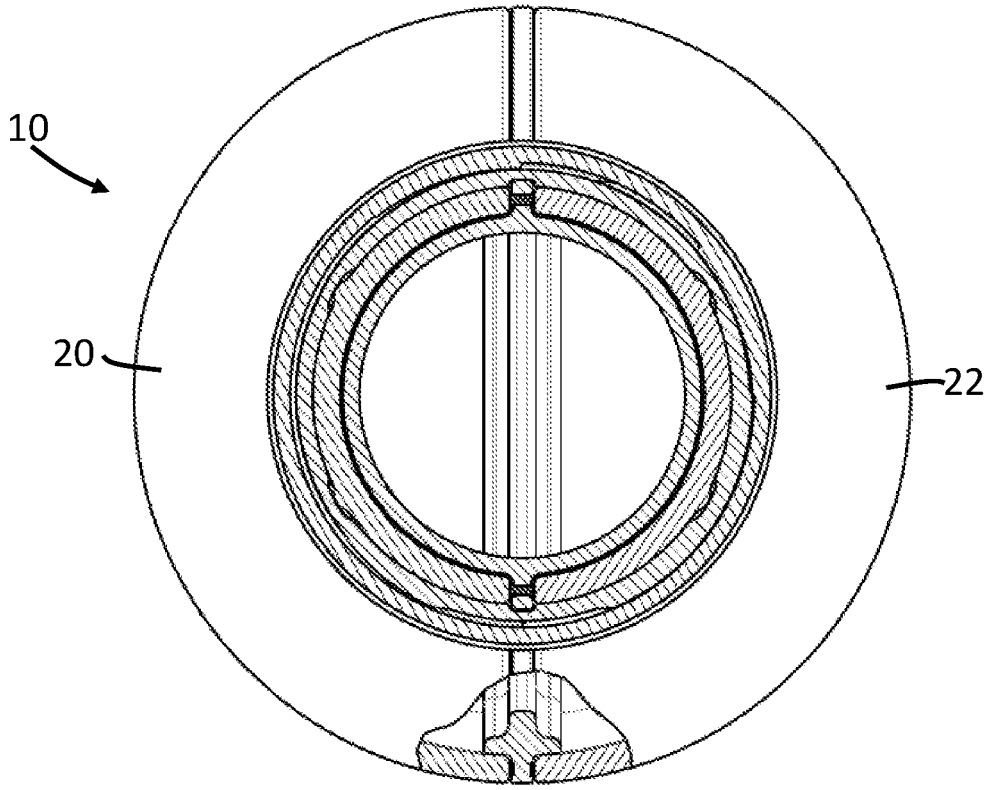
FIG. 12 is a sectional view of the split bottle assembly.

The upper collar 18 includes an annular sidewall 38 having an outer surface with a thread 60 configured to threadably engage a corresponding thread 61 (see FIG. 7) defined on an inner surface of the cap 24. Referring to FIGS. 7-9, the sidewall 38 of the upper collar 18 also includes a plurality of protrusions 62 that extend radially inward, and which are configured to mate with corresponding recesses 64 formed in the neck 40 of the body 12. The protrusions 62 and recesses 64 permit removable fastening of the upper collar 18 to the upper end of the body 12 via a snap-fit connection.

Referring to FIG. 1, in the illustrated embodiment, the cap 24 includes an O-ring 66 (see also FIG. 7) that aids in forming a fluid-tight closure at the opening (i.e., mouth opening) formed by the neck 40 of the body 12 and the upper seal portion 48 of the seal 14.

During assembly of the split bottle assembly 10, the first and second body portions 20, 22 and the seal 14 are brought together as shown in FIG. 1. Next, the lower collar 16 is fastened to the lower end of the body 12, and the upper collar 18 is fastened to the upper end of the body 12. Finally, the cap 24 is fastened to the upper collar 18. During disassembly of the split bottle assembly 10, the reverse of these steps is performed. When the split bottle assembly 10 is in its disassembled state, the several components thereof can be more easily and more thoroughly cleaned by hand and can be more easily loaded into a dishwasher. The ability to more easily and more thoroughly clean the split bottle assembly 10 is advantageous from a hygiene perspective. The ability to provide a thorough cleaning of the split bottle assembly 10 makes it less likely that bacteria will be able to grow in or on the split bottle assembly 10.

The present disclosure describes aspects of the invention with reference to the exemplary embodiments illustrated in the drawings; however, aspects of the invention are not limited to the exemplary embodiments illustrated in the drawings. It will be apparent to those of ordinary skill in the art that aspects of the invention include many more embodiments. Accordingly, aspects of the invention are not to be restricted in light of the exemplary embodiments illustrated in the drawings. It will also be apparent to those of ordinary skill in the art that variations and modifications can be made without departing from the true scope of the present disclosure. For example, in some instances, one or more features disclosed in connection with one embodiment can be used alone or in combination with one or more features of one or more other embodiments.

What is claimed is:

1. A split bottle assembly, comprising:

a body longitudinally split between a first body portion and a second body portion;

a seal between the first and second body portions; and a lower collar and an upper collar removably fastened to a lower end and an upper end of the body, respectively, thereby biasing the first and second body portions towards one another so that the seal forms a continuous fluid-tight seam therebetween;

wherein the first body portion and the second body portion define a single reservoir therebetween when the split bottle assembly is in an assembled state.

2. The split bottle assembly of claim 1, further comprising a cap removably fastened to the upper collar.

3. The split bottle assembly of claim 1, wherein the split bottle assembly defines a fluid tight reservoir appropriate for storing a drinkable liquid when (i) the split bottle assembly is in the assembled state, and (ii) the cap is fastened to the upper collar.

4. The split bottle assembly of claim 1, wherein the first body portion and the second body portion are each made of a hard plastic material.

5. The split bottle assembly of claim 1, wherein the first body portion and the second body portion are each made of a glass material.

6. The split bottle assembly of claim 1, wherein the first and second body portions each include a sidewall portion, a neck portion, and a base portion, which collectively form a sidewall, a neck, and a base of the body, respectively.

7. The split bottle assembly of claim 6, wherein the body has a longitudinal axis extending in a direction between the base and the neck thereof; and wherein, when viewed in respective cross-sectional planes perpendicular to the longitudinal axis, the sidewall and the neck of the body are each annularly shaped and concentrically aligned about the longitudinal axis of the body.

8. The split bottle assembly of claim 1, wherein the seal includes a lower seal portion configured to form the continuous fluid-tight seam between the first and second body portions, and further includes an upper seal portion positioned between the upper collar and the upper end of the body when the upper collar is fastened thereto.

9. The split bottle assembly of claim 8, wherein the lower seal portion defines a generally annular shape when viewed in a cross-sectional plane parallel to a longitudinal axis of the body, and the upper seal portion defines a generally annular shape when viewed in a cross-sectional plane perpendicular to the longitudinal axis of the body.

10. The split bottle assembly of claim 8, wherein the seal is a discrete component relative to the body, and the lower seal portion and the upper seal portion are integrally connected to one another and are made primarily of a hard plastic material.

11. The split bottle assembly of claim 8, wherein the lower seal portion includes a gasket portion made of a rubber material, and/or the upper seal portion includes a gasket portion made of a rubber material.

12. The split bottle assembly of claim 1, wherein the seal is integrally connected with one or both of the first and second body portions.

13. The split bottle assembly of claim 12, wherein the seal is molded onto the first and second body portions.

14. The split bottle assembly of claim 12, wherein the seal includes a lower seal portion configured to form the continuous fluid-tight seam between the first and second body portions, and further includes an upper seal portion positioned between the upper collar and the upper end of the body when the upper collar is fastened thereto;

wherein the lower seal portion includes a first part molded continuously along the lateral edge of the first body portion, and a substantially identical second part molded continuously along the lateral edge of the second body portion;

wherein the upper seal portion includes a first part molded continuously along the upper edge of the first body portion, and a substantially identical second part molded continuously along the upper edge of the second body portion.

15. The split bottle assembly of claim 1, wherein the lower collar is fastened to the lower end of the body via a threaded connection.

16. The split bottle assembly of claim 1, wherein the upper collar is fastened to the upper end of the body via a snap-fit connection.

17. A split bottle assembly, comprising:

a body longitudinally split between a first body portion and a second body portion;

a sealing frame positionable between the first and second body portions;

a lower collar removably fastenable to a lower end of the body; and an upper collar removably fastenable to an upper end of the body;

wherein in an assembled state of the split bottle assembly, the lower and upper collars are fastened to the lower and upper ends of the body, respectively, and thereby bias the first and second body portions towards one another so that the sealing frame forms a continuous fluid-tight seam therebetween;

wherein the first body portion and the second body portion define a single reservoir therebetween when the split bottle assembly is in an assembled state.

* * * * *